US005584332A

United States Patent [19]

Miller

[11] Patent Number: 5,584,332

[45] Date of Patent: Dec. 17, 1996

[54] DOOR ASSEMBLY WITH SUPPORT

[75] Inventor: Stephen J. Miller, Dixon, Ill.

[73] Assignee: Raynor Garage Doors, Dixon, Ill.

[21] Appl. No.: 325,804

[22] Filed: Oct. 19, 1994

[51] Int. Cl.[6] ..... E05D 15/16

[52] U.S. Cl. ..... 160/201; 160/264; 292/DIG. 36

[58] Field of Search ..... 160/201, 264, 160/209; 292/DIG. 36, 24, 32

[56] References Cited

U.S. PATENT DOCUMENTS 2,124,969 7/1938 Bagley et al. ..... 292/DIG. 36

*Primary Examiner*—Blair Johnson

*Attorney, Agent, or Firm*—Tilton, Fallon, Lungmus & Chestnut

[57] ABSTRACT

A door assembly includes an articulated door with rollers mounted along its edge portions and guide and support tracks for securing the door to a wall with an opening that the door closes. The assembly also includes bracket members for supporting the door when a load displaces the door a predetermined distance in a direction generally perpendicularly to the face of the door when the door lies in a closed position.

9 Claims, 2 Drawing Sheets

DOOR ASSEMBLY WITH SUPPORT

BACKGROUND OF THE INVENTION

1. Field of the Invention

This invention relates generally to overhead door assemblies and, more particularly, to overhead door assemblies with supports which resist wind loads and other such loads acting on the door when the door lies in a closed position.

2. Description of the Prior Art

Overhead door assemblies, e.g., garage doors, generally include an articulated door and a guide and support track assemblies which support the door in a raised position and in a lowered position where it closes an opening in a wall. Rollers mounted to edge portions of the door connect the door to a track assembly and allow the door to move between the two positions.

Manufacturers of those prior door assemblies have designed them to withstand loading by normal forces. However, certain areas experience higher than normal forces from the elements. For example, in certain coastal areas, hurricanes and other such disturbances generate winds that move at extremely high velocities. The forces from those winds damage conventional door installations by breaking the door, bending the support track, or bending the stems of the rollers.

One solution to the problem identified above is to provide door assemblies with stronger components that can withstand larger forces. But, this solution substantially increases the cost of the door assembly. The present invention provides a solution without the disadvantage of substantially greater material costs. The door assembly of the present invention includes simple and durable support members that allow a standard door assembly to withstand heavy loading.

SUMMARY OF THE INVENTION

In accordance with one embodiment of this invention, a door assembly includes an articulated door for closing an opening in a wall. Rollers mounted along edge portions of the door and guide and support track means secure the door to the wall and allow it to move between raised and lowered positions. Bracket means support the door when a load displaces the door a predetermined distance in a direction generally perpendicularly to the plane of the wall when the door lies in a lowered or closed position. The bracket means includes at least one bracket member mounted to the door and at least one bracket member mounted to the wall. These brackets cooperate to stop displacement of the door.

BRIEF DESCRIPTION OF THE DRAWINGS

For a more complete understanding of this invention one should now refer to the embodiment illustrated in greater detail in the accompanying drawings and described below by way of an example of the invention. In the drawings.

While the following disclosure describes the invention in connection with one embodiment, one should understand that the invention is not limited to this embodiment. Furthermore, one should understand that the drawings are not to scale and that graphic symbols, diagrammatic representations, and fragmentary views, in part, illustrate the embodiment. In certain instances, the disclosure may not include details which are not necessary for an understanding of the present invention, such as conventional details of fabrication and assembly.

DETAILED DESCRIPTION OF THE DRAWINGS AND AN EMBODIMENT

Figure 1:
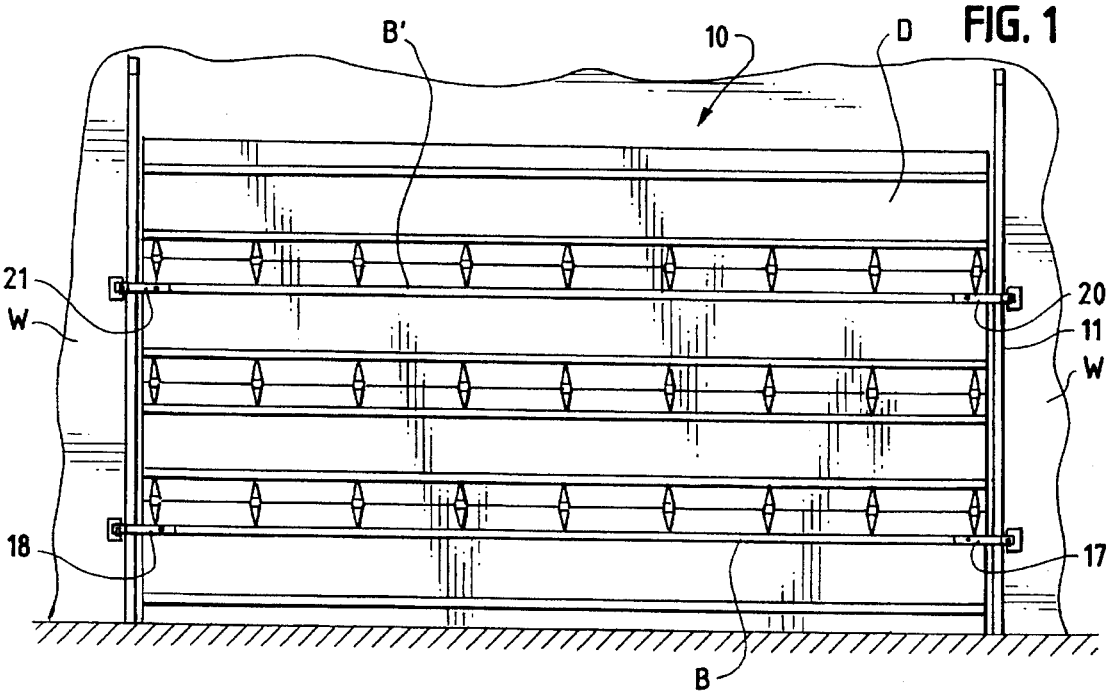
FIG. 1 is an elevation view of a garage door assembly embodying the present invention.

Turning now to the drawings and referring first to FIG. 1, a door assembly 10 (a garage door) generally includes an articulated door D mounted to a wall member W by a pair of guide and support track assemblies 11 and 12. The assemblies 11 and 12 lie on opposite sides of the articulated door D along edge portions of an opening defined by the wall member W. They, as well as the connectors described below, are made of steel or any other material of high strength and rigidity.

Figure 2:
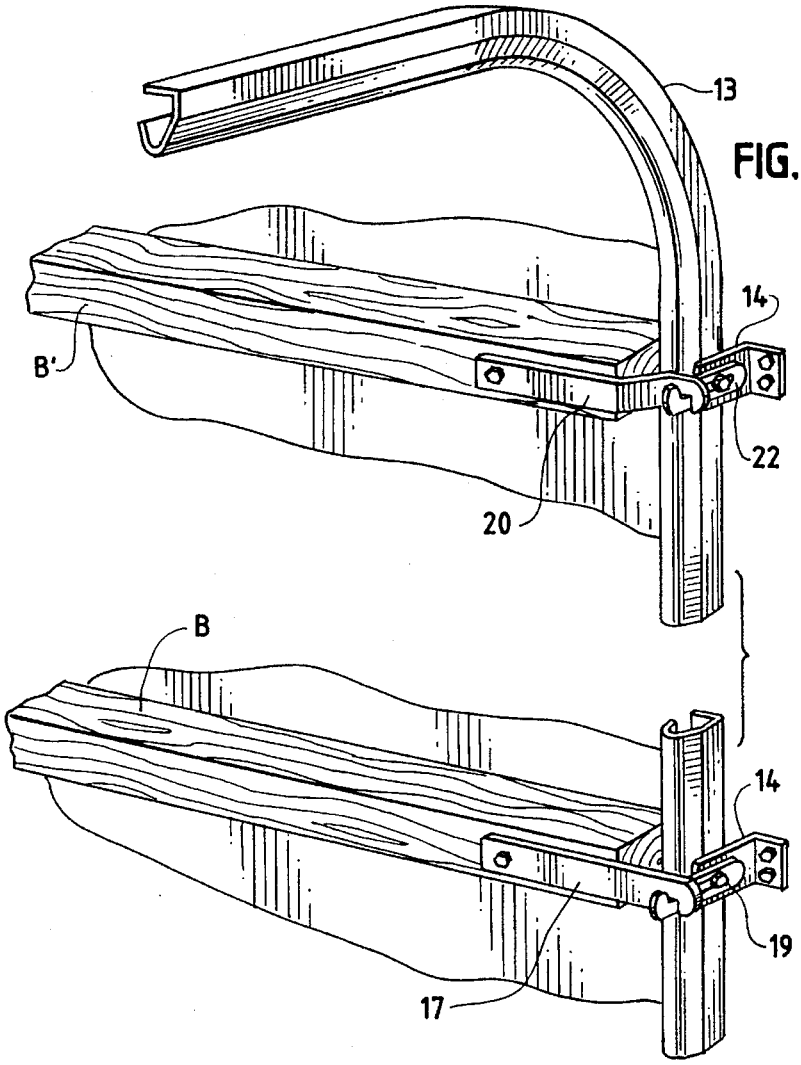
FIG. 2 is a partial perspective view of the door assembly of the present invention, including one of the tracks of the assembly and bracket members used as supports.

The guide and support track assembly 11 includes a track 13 having the overall shape and cross-section configuration shown in FIG. 2. Mounting supports 14 (see also FIGS. 4 and 6) secure the track 13 to the wall member W. (FIG. 2 shows only two of the mounting supports; but the guide and support track assembly may include many more of these support members to keep the track 13 in predetermined alignment.) The assembly 12 includes the same components that the assembly 11 includes.

Figure 4:
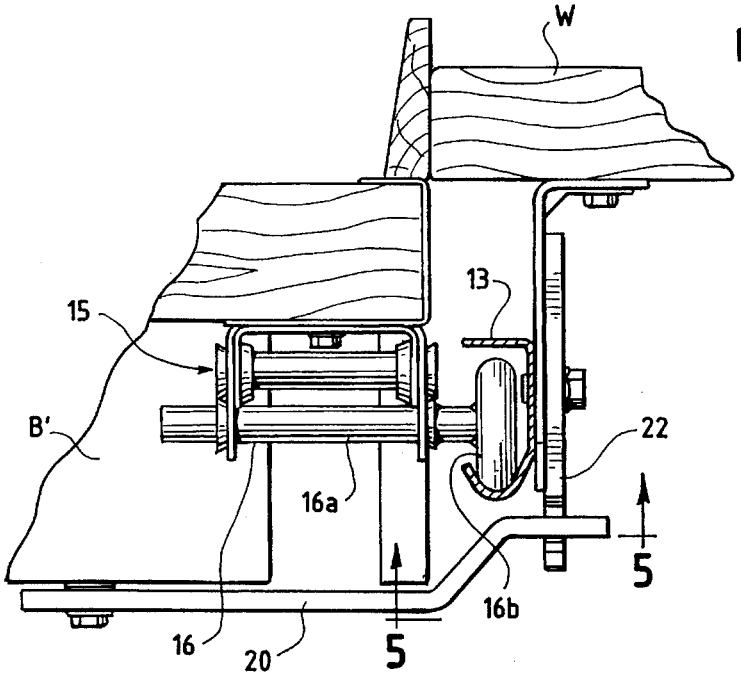
FIG. 4 is a sectional view taken through a horizontal plane through the guide and support track along one side of the assembly above the top support brackets shown in FIG. 2.
Figure 6:
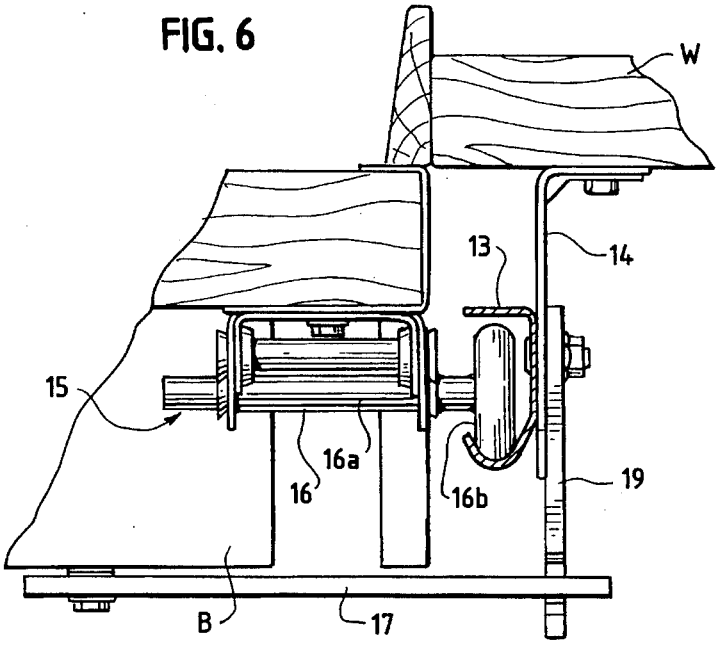
FIG. 6 is a sectional view taken through a horizontal plane through the guide and support track of FIG. 4 between the top and bottom brackets shown in FIG. 2.

Roller assemblies 15 mounted to edge portions of the articulated door D on opposite sides of the door allow the door to ride in the tracks 13 of the guide and support track assemblies 11 and 12 and move between the lowered position shown in FIG. 1 (in which it closes the opening in the wall W) and a raised position (not shown). Each roller assembly includes a roller 16 with a stem portion **16*a* and a wheel portion 16*b* which rides in the track 13 as shown in FIGS. 4 and 6**.

A first bracket member 17 and a second bracket member 18 lie secured to a cross brace B of the door D and cooperate with a corresponding third bracket member 19 and a fourth bracket member (not shown), respectively, to stop displacement of the bottom portion of the door D in a direction generally perpendicularly to the plane or face of the door D when it lies in the position shown in FIG. 1. Similarly, a fifth bracket member 20 and a sixth bracket member 21 lie secured to a cross brace $B^1$ of the door D and cooperate with a corresponding seventh bracket member 22 and an eighth bracket member (not shown), respectively, to stop displacement of the top portion of the door D. Thus, the bracket members prevent displacement of the door before bending of the roller stems and track or any other such damage occurs.

The first bracket member 17 and the third member 19 comprise a cooperating pair that is the same as the one formed by the second member 18 and the fourth bracket member. Moreover, the fifth member 20 and the seventh member 22 comprise a cooperating pair that is the same as the one formed by the sixth member 21 and the eighth bracket member. When the door D lies in the closed position shown in FIG. 1, these four pairs loosely couple in the manner shown in FIG. 5. If the door D moves perpendicularly to its face or the plane of the wall W, the wall mounted bracket members stop the door mounted bracket members.

Figure 5:
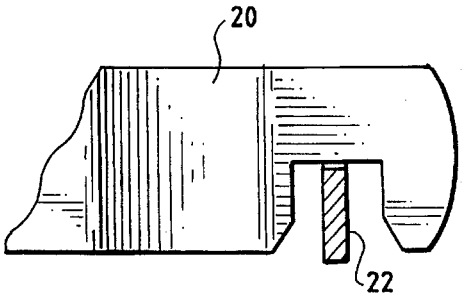
FIG. 5 is a sectional view taken along line 5—5 in FIG. 4.

The third bracket member 19, the fourth bracket member, the seventh bracket member 22, and the eighth bracket member are flat, elongate strips made of steel or any other material of high strength and rigidity. In the embodiment shown, they are virtually identical members, but they may have different shapes and sizes. Each one of these bracket members defines an elongate slot which allows mounting with a bolt to a support 14 and adjusting to the staggered relationship shown in FIG. 3 (for the reason discussed below). Each of these bracket members also defines a groove at one of its end portions to allow the coupling with a corresponding bracket member, as shown in FIGS. 2 and 5.

The first bracket member 17 and the second bracket member 18 are also flat, elongate strips made of steel or any other material of high strength and rigidity. They are virtually identical members, but they, like the four bracket members described above, may have different shapes and sizes. Each defines at least one opening through which screws or other securing means may secure it to the cross brace B. Each also defines a groove at one of its end portions to allow the coupling with a corresponding bracket member, as shown in FIGS. 2 and 5.

Figure 3:
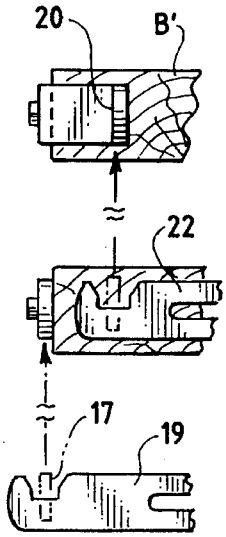
FIG. 3 is a partially schematic side elevation of the bracket members used to support the assembly.

The fifth bracket member 20 and the sixth bracket member 21 are also elongate strips made of steel or any other material of high strength and rigidity. In addition, they have the securing opening and groove of the other bracket members. However, the end portion that defines the groove is an offset portion (see FIG. 4) so that it may engage the corresponding wall-mounted brackets. The top wall mounted bracket members (the seventh and eighth bracket members) lie inwardly of the bottom wall mounted bracket members (as shown in FIG. 3) so that the bottom door mounted bracket members (17 and 18) do not engage them when the door moves from the lowered position of FIG. 1 to the raised position (not shown). Thus, the fifth bracket member 20 and the sixth bracket member 21 require the offset to reach the corresponding brackets with which they cooperate.

While the above description and the drawings disclose and illustrate one embodiment, one should understand, of course, that the invention is not limited to this embodiment. Those skilled in the art to which the invention pertains may make modifications and other embodiments employing the principles of this invention, particularly upon considering the foregoing teachings. For example, although the embodiment shown above includes four bracket pairs, the door assembly may include fewer than four pairs or more than four pairs. Therefore, by the appended claims, the applicant intends to cover any modifications and other embodiments as incorporate those features which constitute the essential features of this invention.

What is claimed is:

1. In a door assembly having an articulated door for closing an opening in a wall member and track and roller means for mounting the door to the wall member, first and second bracket means for supporting the door when a load displaces the door a predetermined distance in a direction generally perpendicularly to the plane of the door when the door lies in a closed position, the first bracket means mounted to the door and the second bracket means mounted to the wall member, the each of first bracket means and the second bracket means including irregular portions that interlock to limit displacement of the door in a direction generally perpendicular to the door and in a direction generally parallel to the door.

2. The assembly of claim 1, wherein the first bracket means includes first and second bracket members on opposite sides of the door and the second bracket means includes third and fourth bracket members on opposite sides of the door.

3. The assembly of claim 2, wherein the first bracket means includes fifth and sixth bracket members on opposite sides of the door and the second bracket means includes seventh and eighth bracket members on opposite sides of the door, the fifth and sixth brackets are spaced apart from the first and second bracket members and the seventh and eighth bracket members are spaced apart from the third and fourth bracket members.

4. The assembly of claim 1, wherein the first bracket means includes a plurality of bracket members and the second bracket means includes a plurality of bracket members, each bracket member including an elongate strip with the irregular portion comprising a groove formed into an end portion of the strip.

5. The assembly of claim 4, wherein the bracket members of the first bracket means lie generally parallel to the plane of the door when the door lies in a closed position and the bracket members of the second bracket means lie generally perpendicularly of the bracket members of the first bracket means when the door lies in a closed position.

6. The assembly of claim 3, wherein each of the bracket members includes an elongate strip with the irregular portion comprising a groove formed into an end portion of the strip for coupling with a grooved portion of a corresponding bracket member.

7. The assembly of claim 6, wherein the bracket members of the first bracket means lie generally parallel to the plane of the door when the door lies in a closed position and the bracket members of the second bracket means lie generally perpendicularly of the bracket members of the first bracket means when the door lies in a closed position.

8. The assembly of claim 7, wherein the third and fourth bracket members extend a first predetermined distance outwardly of the wall member and the seventh and eighth bracket members extend a second predetermined distance outwardly of the wall member, said second distance being smaller than said first distance to allow the first and second bracket members to move past the seventh and eighth bracket members when the door moves between an open and closed position.

9. The assembly of claim 8, wherein the first and second bracket members are flat and elongate and the fifth and sixth members include an offset end portion which includes the groove.

* * * * *